US009009876B2

(12) United States Patent
Coscarella

(10) Patent No.: US 9,009,876 B2
(45) Date of Patent: Apr. 21, 2015

(54) DRAIN COVER WITH LOCKING MECHANISM

(76) Inventor: Gabe Coscarella, Edmonton (CA)

( * ) Notice: Subject to any disclaimer, the term of this patent is extended or adjusted under 35 U.S.C. 154(b) by 717 days.

(21) Appl. No.: 12/950,956

(22) Filed: Nov. 19, 2010

(65) Prior Publication Data

US 2011/0168711 A1 Jul. 14, 2011

(30) Foreign Application Priority Data

Nov. 20, 2009 (CA) ..... 2686031
Feb. 4, 2010 (CA) ..... 2691636

(51) Int. Cl.
*A47K 1/14* (2006.01)
*E03F 5/06* (2006.01)

(52) U.S. Cl.
CPC ..... *E03F 5/06* (2013.01); *E03F 2005/063* (2013.01)

(58) Field of Classification Search
USPC ..... 4/286–295
See application file for complete search history.

(56) References Cited

U.S. PATENT DOCUMENTS 667,333 A 2/1901 Pflugh
739,589 A 9/1903 Clifford
1,640,969 A 8/1927 Westerman
1,771,522 A 7/1930 Berge
2,277,713 A 3/1942 Parker
2,800,231 A * 7/1957 Hicks ..... 210/463
2,893,437 A 7/1959 Rickard
3,148,708 A 9/1964 Panella
3,445,867 A * 5/1969 Walther ..... 4/288
3,578,200 A 5/1971 Hetzer
3,675,685 A 7/1972 Potter
3,893,487 A 7/1975 Engelking
3,993,102 A 11/1976 Polster
4,447,918 A * 5/1984 Cuschera ..... 4/286
6,567,996 B2 * 5/2003 Rao ..... 4/286
6,802,962 B1 * 10/2004 Browne et al. ..... 210/164
7,121,526 B2 10/2006 Alvarez
7,171,987 B2 2/2007 Serret
2002/0104156 A1 * 8/2002 Rao ..... 4/286
2004/0073992 A1 * 4/2004 Saman et al. ..... 4/287

* cited by examiner

*Primary Examiner* — Lauren Crane
(74) *Attorney, Agent, or Firm* — Christensen O'Connor Johnson Kindness PLLC

(57) ABSTRACT

A drain cover with a locking mechanism which includes a cylindrical body with a first end, a second end, an end wall at the first end and a peripheral sidewall that extends between the first end and the second end. The peripheral sidewall has an exterior surface and an interior surface which define an interior bore. Rotatable fasteners extend from the end wall to the second end. Drain cover is adapted to fit into a pipe. A cam member extends radially from each rotatable fastener. The cam member is movable from a release position to a locking position upon rotation of each rotatable fastener such that in the release position the cam member is spaced from an interior wall of the pipe and in the locking position the cam member is engaged with the interior wall of the pipe.

5 Claims, 5 Drawing Sheets

DRAIN COVER WITH LOCKING MECHANISM

FIELD

There is described a locking mechanism for securing in place a cover that prevents objects from falling down drains and other vertical pipes.

BACKGROUND

Drain covers serve an important function of preventing objects from falling down drains. There is a need for a locking mechanism for securing the drain covers in place, so that they are not readily removed.

SUMMARY

There is provided a drain cover with a locking mechanism which includes a cylindrical body with a first end, a second end, an end wall at the first end and a peripheral sidewall that extends between the first end and the second end. The peripheral sidewall has an exterior surface and an interior surface which define an interior bore. Rotatable fasteners extend from the end wall to the second end. Drain cover can be placed in a pipe. A cam member extends radially from each rotatable fastener. The cam member is movable from a release position to a locking position upon rotation of rotatable fasteners such that in the release position the cam member is spaced from an interior wall of the pipe and in the locking position the cam member is engaged with the interior wall of the pipe.

The drain cover, as described above, can readily be placed in the locking position by movement of each cam member. One further advantage this drain cover has over other drain covers, is that a central flow path is left free of any obstacles that might otherwise catch debris.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
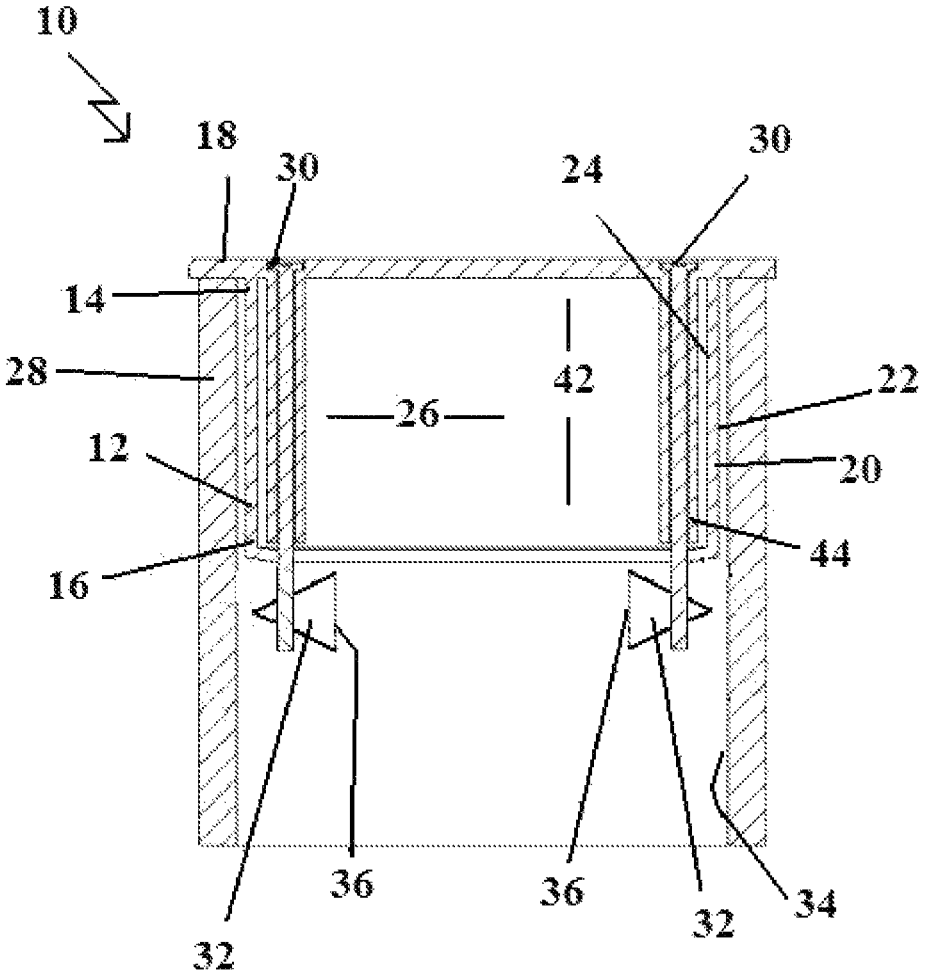
FIG. 1 is a side elevation view in section of the drain cover in accordance with the teachings of the present invention.

Structure and Relationship of Parts:

A drain cover generally identified by reference numeral 10, will now be described with reference to FIGS. 1 through 5.

Referring to FIG. 1 there is illustrated a drain cover 10 with a locking mechanism, which has a cylindrical body 12 with a first end 14, a second end 16, an end wall 18 at first end 14 and a peripheral sidewall 20 that extends between first end 14 and second end 16. Peripheral sidewall 20 has an exterior surface 22 and an interior surface 24 which defines an interior bore 26. Drain cover 10 is adapted to fit into a pipe 28.

Figure 2:
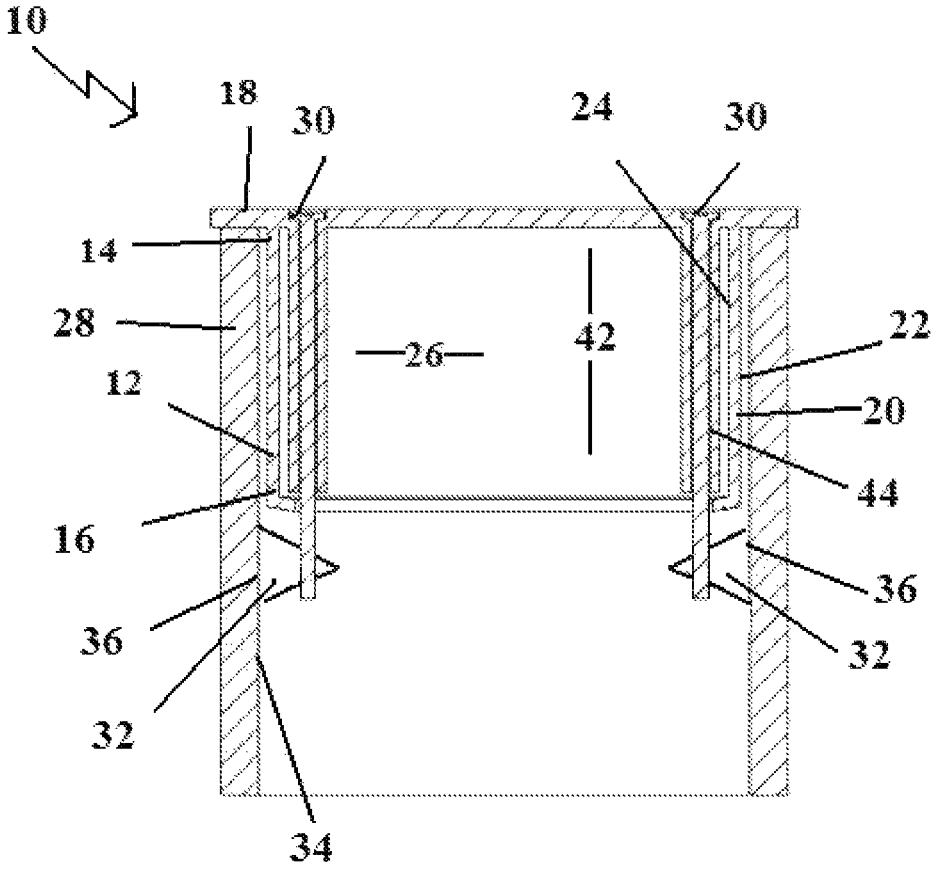
FIG. 2 is a side elevation view in section of the drain cover in illustrated in FIG. 1, in the locking position.
Figure 3:
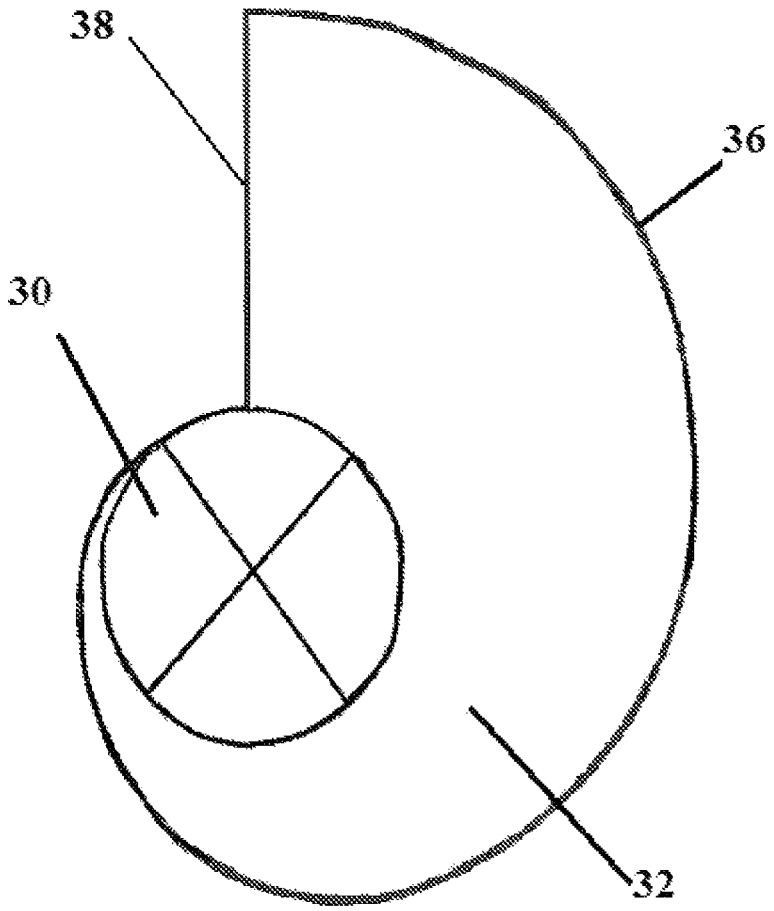
FIG. 3 is top plan view of a cam member of the drain cover illustrated in FIG. 1.
Figure 5:
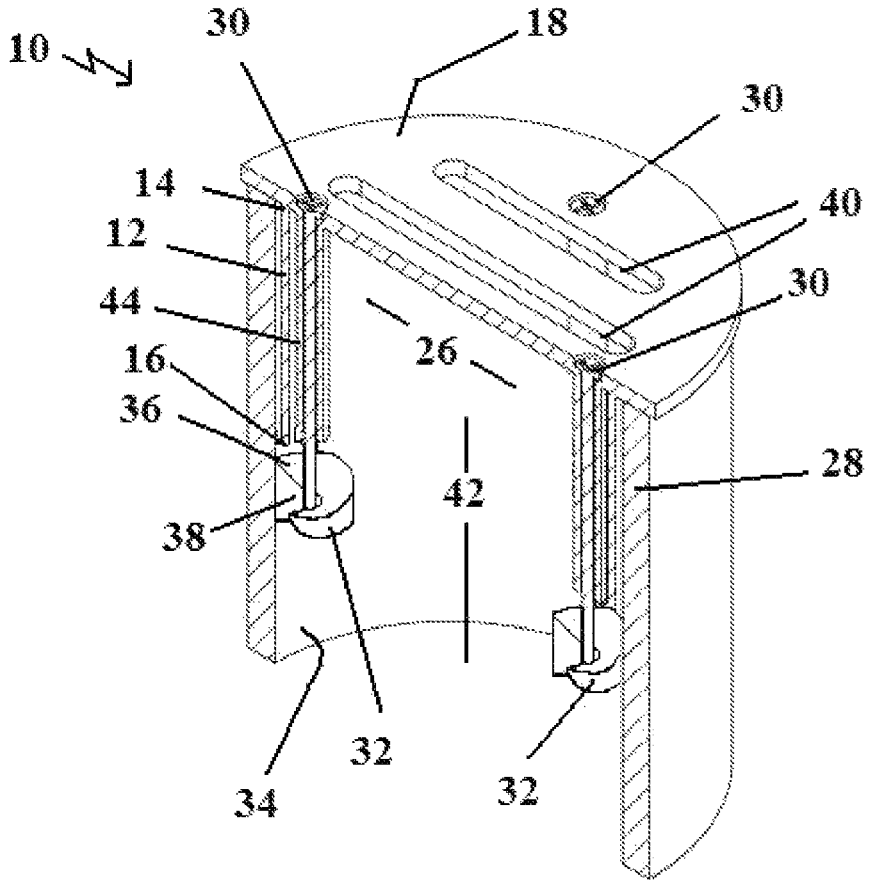
FIG. 5 is a perspective view in section of the drain cover.

At least one rotatable fastener 30 is provided which extends from end wall 18 to second end 16. Referring to FIG. 3, a cam member 32 extends radially from each of the at least one rotatable fasteners 30. Referring to FIG. 1, upon rotation of the rotatable fastener 30, cam member 32 is movable from a release position illustrated in FIG. 1, to a locking position as illustrated in FIG. 2. In the release position, cam member 32 is spaced from an interior wall 34 of pipe 28 as illustrated in FIG. 1. When rotated into the locking position, cam member 32 is engaged with interior wall 34 of pipe 28 as illustrated in FIG. 1. Referring to FIG. 3, in the illustrated embodiment, cam member 32 has surface engaging portion 36 that is lobe shaped with a truncated end 38 however it will be appreciated that cam member 32 can have varying shapes so long as the shape is suitable for engagement with interior wall 34 of pipe 28 as illustrated in FIG. 5.

Figure 4:
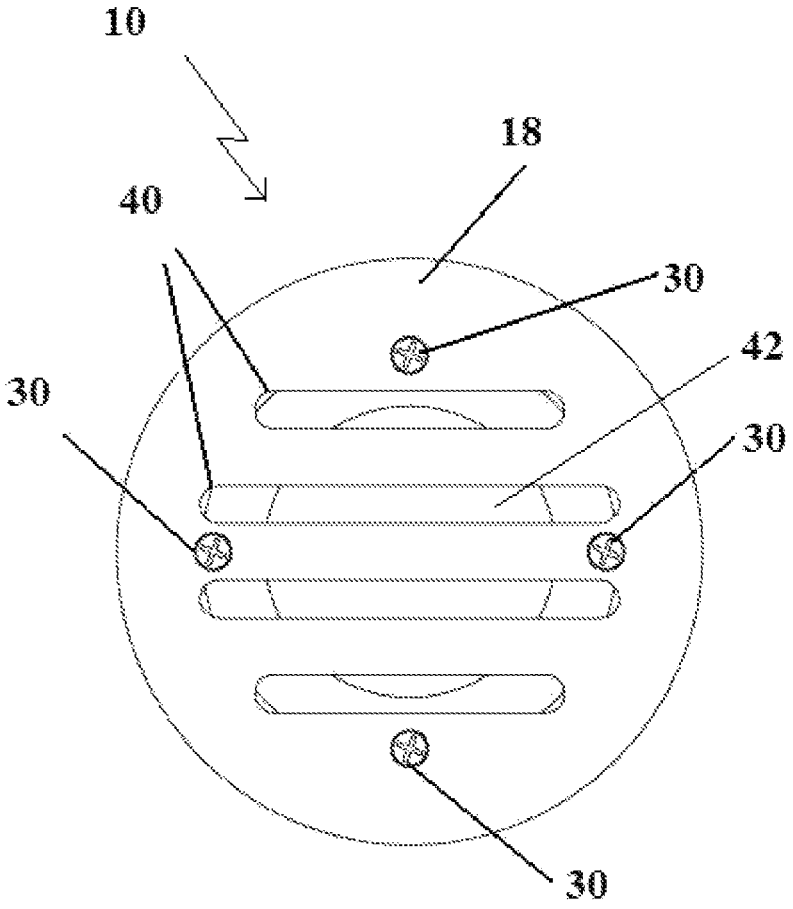
FIG. 4 is a top plan view of the drain cover.

Referring to FIG. 4, end wall 18 has drainage openings 40 which allow flow through a central flow path 42 provided by interior bore 26 as illustrated in FIG. 1, which is left free of any obstacles that might otherwise catch debris. Alternatively, end wall 18 could also be devoid of any drainage openings 40. End wall 18 could also be designed to have a cover plate (not shown) attached, where end wall 18 may fit within pipe 28 and the cover plate would perform the same function as end wall 18 in the depicted embodiments. Referring to FIGS. 1 and 2, sleeves 44 are provided in drain cover for receiving rotatable fasteners 30. Referring to FIG. 4, in the illustrated embodiment, four rotatable fasteners 30 are provided, however that number can vary.

Operation:

The use and operation of drain cover 10 will now be described with reference to FIGS. 1 through 5.

Referring to FIG. 1, drain cover 10 is placed in pipe 28 while rotatable fasteners 30 are in the release position. Once drain cover 10 is properly positioned within pipe 28, rotatable fasteners 30 can be rotated. As rotatable fasteners 30 are rotated, cam member 32 is moved from the release position illustrated in FIG. 1 to the locking position illustrated in FIG. 2, such that surface engaging portion 36 of each cam member 32 is tightly engaged with interior wall 34 of pipe 28. Once locked in position, drain cover 10 will remain in place until it is desirable to remove drain cover 10 from pipe 28. To remove drain cover 10, rotatable fasteners 30 are loosened such that cam member 32 is moved back to the release position disengaged from exterior surface 22 as illustrated in FIG. 1, and drain cover 10 can be removed from pipe 28.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A drain cover with a locking mechanism, comprising:

a cylindrical body having a first end, a second end, an end wall at the first end and a peripheral sidewall that extends between the first end and the second end, the peripheral sidewall having an exterior surface and an interior surface which defines an interior bore;

at least one rotatable fastener extending from the end wall to the second end;

a cam member carried by and extending radially from each rotatable fastener such that the cam member rotates with the rotatable fastener, the cam member being movable from a release position to a locking position upon rotation of the at least one rotatable fastener such that in the release position the cam member is retracted from an interior wall of a pipe into which drain cover is inserted and in the locking position the cam member is rotated to extend outward relative to the release position such that the cam member engages the interior wall of the pipe, the cam member comprising a surface engaging portion for engaging the interior surface of a pipe wall in the locking position, the surface engaging portion being defined by an engagement surface that spirals outward as it extends around the rotatable fastener perpendicularly to an axis of rotation of the rotating fastener such that the engagement surface moves toward the interior wall of the pipe as the cam member rotates from the release position to the locking position.

2. The drain cover of claim 1, wherein the end wall has drainage openings.

3. The drain cover of claim 1, wherein the end wall is devoid of drainage openings.

4. The drain cover of claim 1, wherein the cam member is positioned at a remote end of the at least one rotatable fastener.

5. The drain cover of claim 1, wherein the cam member is of a resilient material.

* * * * *